United States Patent [19]

Diamond et al.

[11] 4,272,203

[45] Jun. 9, 1981

[54] APPARATUS FOR ADAPTING AN OFFICE MACHINE TO ONE-HANDED OPERATION

[76] Inventors: Kenneth B. Diamond; Lynda R. Diamond, both of 3102 W. Augusta, Phoenix, Ariz. 85021

[21] Appl. No.: 13,155

[22] Filed: Feb. 21, 1979

[51] Int. Cl.[3] ..... B41J 25/08; B41J 29/00

[52] U.S. Cl. ..... 400/272

[58] Field of Search ..... 400/272, 273

[56] References Cited

U.S. PATENT DOCUMENTS

| | | | |
|---|---|---|---|
| 458,522 | 8/1891 | Davis | 400/272 |
| 566,536 | 8/1896 | Rich et al. | 400/273 |
| 751,578 | 2/1904 | Wadewitz | 400/273 |
| 843,032 | 2/1907 | Powell | 400/272 |
| 944,590 | 12/1909 | Beyerlen | 400/272 |
| 1,413,342 | 4/1922 | Loomis | 400/273 |

*Primary Examiner*—S. Leon Bashore
*Assistant Examiner*—Steve Alvo
*Attorney, Agent, or Firm*—Drummond and Nelson

[57] ABSTRACT

Apparatus for modifying a key-operated office machine such as a typewriter to adapt the machine to one-handed operation. A depressible bar member is shaped and dimensioned to be operatively positioned below and across the keyboard and a pair of mounting arms extend perpendicularly from the bar member toward an engaging horizontal edge of the machine cabinet. A key depressor is operatively associated with the bar and the arms and located above at least one of the keys of the machine such that the key is depressed when the bar is depressed. Means are provided for normally urging the bar member upwardly to prevent the key being depressed until downward pressure is exerted on the bar by the operator.

1 Claim, 4 Drawing Figures

APPARATUS FOR ADAPTING AN OFFICE MACHINE TO ONE-HANDED OPERATION

This invention relates to apparatus for modifying a key-operated office machine to adapt the machine to more facile one-handed operation.

In another respect, the invention pertains to apparatus for modifying a key-operated office machine such as a typewriter, telex, bookkeeping machine, or the like, which is normally manipulated by both hands of the operator to facilitate operation of the machine by one hand.

In a particular respect, the invention concerns apparatus for operating the so-called "shift" key of a typewriter to permit the operator to depress the shift key with the heel or side of the hand or thumb striking one of the letter keys to type a capital letter with one of the fingers.

Standard office machines such as typewriters, teletypewriters, bookkeeping machines, etc. are commonly designed for normal operation by an operator having use of both of his hands. Such machines are possible to operate by an operator having use of only one of his hands but the speed with which the machines can be operated is measurably reduced. For example, a one-handed operator would have to type a capital letter by first depressing the shift lock key, striking the letter key and then releasing the shift lock key in three separate operations. Similar difficulties would be encountered with the so-called "repeat" key on a conventional telex machine while simultaneously depressing a number or letter key located far across the keyboard.

Various attempts have been made to modify such office machines to facilitate one-handed operation by providing specially designed keyboards which involve a re-arrangement of the type characters and such attempts have been proven partially successful. Further attempts have been made to provide means for simultaneously depressing certain keys of these machines by the operator's fingers while simultaneously depressing others of the keys by other portions of the operator's body such as the heel or side of the hand, the forehead, etc. However, such attempts at further modifications have not proven generally practical, primarily due to the necessity for making expensive and extensive physical modifications of the machine.

It would be highly beneficial to provide simple apparatus for adapting a key-operated office machine to one-handed operation, which apparatus can be quickly and conveniently installed without special tools and without requiring physical modifications of the machine or the cabinetry thereof.

Accordingly, it is a principle object of the present invention to provide apparatus for modifying a key-operated office machine to facilitate one-handed operation.

Yet another object of the invention is to provide apparatus for making such modifications which can be quickly and conveniently installed on standard commercially available key-operated office machines such as typewriters, teletypewriters, bookkeeping machines and the like.

A further and more specific object of the invention is to provide apparatus for quickly and conveniently modifying a standard typewriter or teletypewriters to provide for simultaneous one-handed depression of both the shift key and a character key.

These and other, further and more specific objects and advantages of the invention will be apparent to those skilled in the art from the following detailed description thereof, taken in conjunction with the drawings, in which.

Briefly, in accordance with the invention, I provide apparatus for modifying a key-operated office machine to achieve the foregoing objectives. Such machine normally includes a plurality of finger-operated keys arranged to form a keyboard and a cabinet enclosing the machine, including means defining a horizontal edge of the cabinet extending across and to the rear of the keyboard. The apparatus provided by the present invention permits selected ones of the keys to be depressed by a body member of the operator of the machine while simultaneously depressing one of the character keys and, comprises a depressible bar member shaped and dimensioned to be operatively positioned horizontally across and below the keyboard, a pair of mounting arms extending perpendicularly from the bar member, each arm terminating in means shaped and dimensioned to detachably engage said horizontal edge of the machine cabinet to position the bar member in operative position and permit vertical movement thereof, a key depressor member operatively associated with the depressible bar member and the mounting arms, the key depressor being located above at least a selected one of the keys of the machine and operable when the bar member is depressed to simultaneously depress the selected key, and means for normally urging the bar member and the key depressor upwardly to prevent the selected key from being depressed until downward pressure is exerted on the bar member by the operator.

Figure 1:
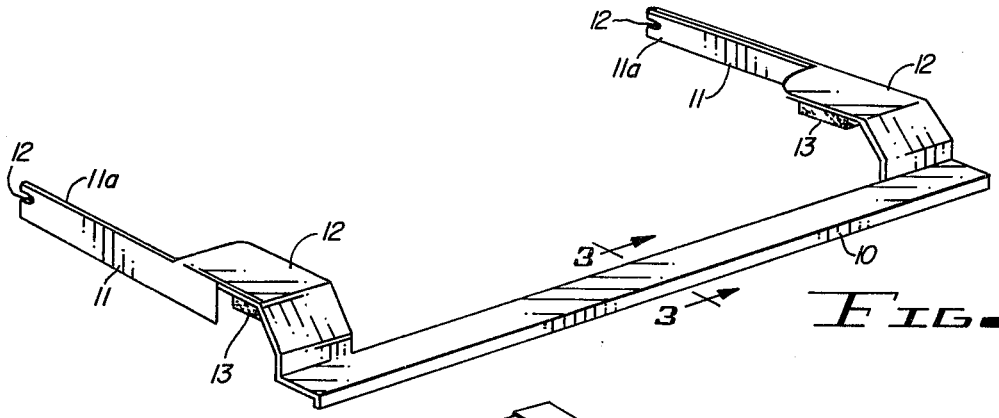
FIG. 1 illustrates an attachment for a standard typewriter which permits simultaneous one-handed operation of the shift key by the operator's palm or heel or edge of the operator's hand while simultaneously depressing one of the character keys with one of the fingers of the same hand.

Turning now to the drawings, which illustrate the presently preferred embodiment of the invention for the purpose of illustrating the practice thereof and not be way of limitation of the scope thereof, FIG. 1 depicts a device of the character described which includes an elongate bar 10 and attaching arms 11 extending perpendicularly therefrom. A pair of key depressors 12 are formed integrally with the bar 10 and the attaching arms 11. Each of the terminal ends 11A of the attaching arms 11 has a slot 12 formed therein, the purpose of which will be further explained below. Resilient compressible members 13 are provided on the under sides of the key depressor portions 12.

Figure 2:
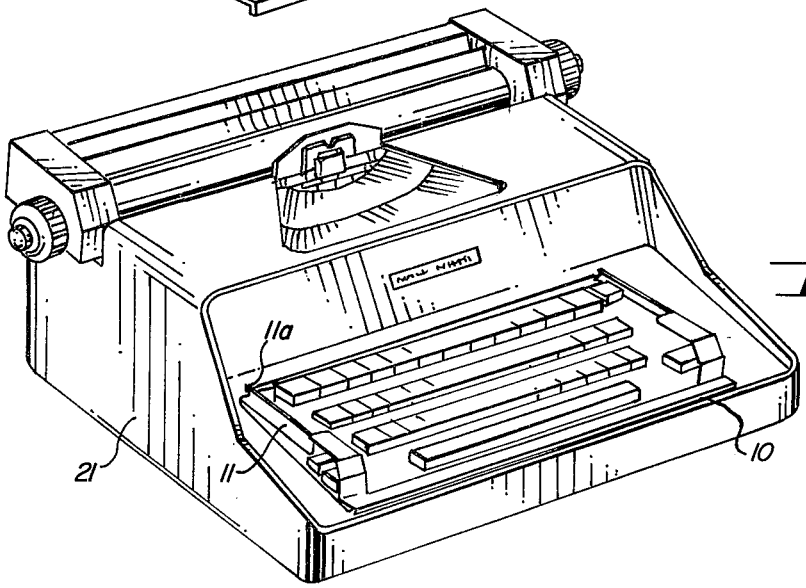
FIG. 2 is a persepective view of a standard typewriter showing the device of FIG. 1 installed in operative position.
Figure 3:
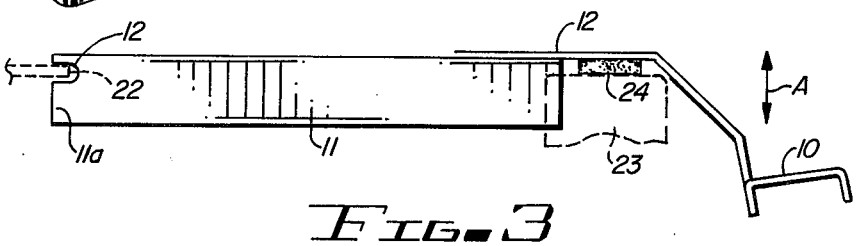
FIG. 3 is a partial sectional side view of the machine of FIG. 2 which illustrates the operative attachment and positioning of the device of FIG. 1 on the typewriter of FIG. 2.
Figure 4:
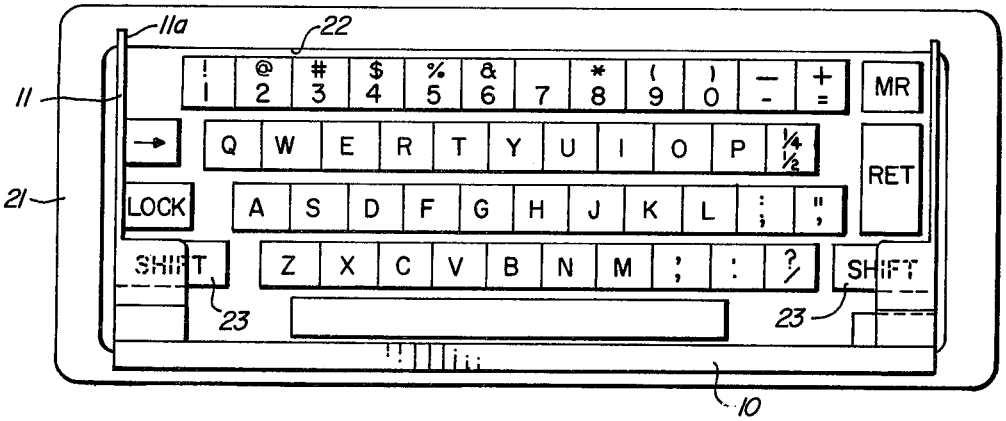
FIG. 4 is a plan view showing the keyboard portion of the typewriter of FIG. 2 with the device of FIG. 1 in its operative position.

As depicted in FIGS. 2–4, the device of FIG. 1 is attached to a standard typewriter 21 by engaging a horizontal edge 22 of the cabinet of the typewriter 21 within the slot 12 formed in the terminal ends 11A of each of the attaching arms 11. In this operative position, the operating bar 10 is affixed for vertical movement in the directions of the double arrows A, pivoting around the connection between the terminal ends 11A of the attaching arms 11 and the edge 22 of the typewriter cabinet. The key depressors 12 of the device of FIG. 1 are positioned to overlie the shift keys 23 of the keyboard of the typewriter 21 and are shaped, as shown, to avoid striking any of the other keys of the keyboard when the bar 10 is depressed. A compressible, sponge-rubber pad 24 is positioned between the key depressors 12 and the keys 23 to normally urge the bar 10 upwardly but to compress when the bar 10 is depressed to simultaneously depress the shift keys.

As will be apparent to those skilled in the art, downward pressure by the operator such as by pressure from the heel or side of the operator's palm or thumb on the bar 10 will cause the shift keys 23 to be simultaneously depressed, allowing the operator to strike one of the character keys with a finger of the same hand to produce a capital or other upper register character by the use of only one hand and without the necessity for the separate operations of depressing the shift lock key, the character key and releasing the shift lock, thereby increasing materially the speed and facility with which the typewriter can be operated.

Where the machine has a keyboard specially arranged to facilitate one-handed typing, use of the apparatus described herein even permits the shift key to be depressed by the thumb without moving the fingers from the home position. Even when a standard keyboard machine is operated by a two-handed operator, the apparatus of the invention may be usefully employed to permit the shift keys to be operated by the thumbs rather than the weaker little fingers.

Having described my invention in such terms as to enable those skilled in the art to understand and practice it, and having described the presently preferred embodiment thereof, I claim:

1. Apparatus for modifying a key-operated office machine, said machine including, a plurality of finger-operated keys arranged to form a keyboard, and a cabinet enclosing said machine, including means defining a horizontal edge of said cabinet extending across the rear of the keyboard, said apparatus being quickly and conveniently installed on said office machine without requiring physical modification thereof and being arranged to permit selected ones of said keys to be manually depressed by a body member of the operator of said machine while simultaneously depressing one of the character keys, said apparatus comprising:

(a) a substantially rigid depressible bar member shaped and dimensioned to be operatively positioned horizontally across and below said keyboard;

(b) a pair of substantially rigid mounting arms attached to and extending perpendicularly to said bar member, each of said arms terminating in means shaped and dimensioned to detachably engage said horizontal edge of said machine cabinet, to position said bar member in said operative position and permit vertical movement thereof said arms shaped and dimensioned to pivot about said horizontal edge when said bar member is depressed and engaging said cabinet without structural modification thereof;

(c) a key depressor member operatively associated with said bar member and said arms, said depressor being located above at least a selected one of the keys of said office machine and operable when said bar member is depressed to depress said selected key;

(d) means for normally urging said bar member and said key depressor upwardly to prevent said key being depressed until downward pressure is exerted on the bar member by the operator, said elastic means attached to the key depressor and contacting said key and generating an upward force on said bar member; and (e) said key depressor operable when said bar member is depressed to compress said elastic means, said elastic means depressing the key in contact therewith.

* * * * *